US008881318B2

(12) United States Patent
Stammel et al.

(10) Patent No.: US 8,881,318 B2
(45) Date of Patent: Nov. 11, 2014

(54) SANITARY INSTALLATION AND MOUNT FOR FIXING A SANITARY INSTALLATION

(75) Inventors: Thomas Stammel, Hornberg (DE); Bernd Bischler, Haslach (DE); Juan Angel de la Corte, Hornberg (DE); Bernhard Nikulski, Sankt Georgen/Schwarzwald (DE)

(73) Assignee: Duravit Aktiengesellschaft, Hornberg (DE)

( * ) Notice: Subject to any disclaimer, the term of this patent is extended or adjusted under 35 U.S.C. 154(b) by 944 days.

(21) Appl. No.: 12/954,582

(22) Filed: Nov. 24, 2010

(65) Prior Publication Data

US 2011/0126346 A1 Jun. 2, 2011

(30) Foreign Application Priority Data

Nov. 27, 2009 (DE) ..... 10 2009 055 977

(51) Int. Cl.
*E03D 11/00* (2006.01)
*E03D 11/14* (2006.01)

(52) U.S. Cl.
CPC ..... *E03D 11/14* (2013.01)
USPC ..... 4/252.2; 4/647

(58) Field of Classification Search
CPC ..... E03D 11/14; E03D 11/135
USPC ..... 4/252.1–252.6, 647, 648
See application file for complete search history.

(56) References Cited

U.S. PATENT DOCUMENTS 4,058,859 A 11/1977 Arrowood

FOREIGN PATENT DOCUMENTS

| | | | |
|---|---|---|---|
| CN | 1332297 | A | 1/2002 |
| CN | 201078028 | Y | 6/2008 |
| DE | 9103334 | U1 | 6/1991 |
| DE | 10163776 | | 7/2003 |
| DE | 202007017328 | U1 | 2/2008 |
| EP | 1338711 | A1 | 8/2003 |
| GB | 1228375 | | 4/1971 |
| GB | 1449173 | | 9/1976 |
| NL | 9102014 | A | 6/1993 |
| NL | 9401071 | A | 2/1996 |
| TW | 499941 | U | 8/2002 |
| TW | 561875 | U | 11/2003 |
| TW | M245937 | U | 10/2004 |
| WO | 2006099644 | A1 | 9/2006 |
| WO | 2009071178 | A1 | 6/2009 |

*Primary Examiner* — Tuan N Nguyen
(74) *Attorney, Agent, or Firm* — Lucas & Mercanti, LLP

(57) ABSTRACT

Sanitary installation with basin body to be mounted in a suspended manner, wherein on the wall for fixing at least two bolt-type wall mounts are provided, wherein at least one mount is provided, which in relation to the assembled position has at least one transverse perforation (9) in the longitudinal direction of the wall mounts for receiving a wall mount and a threaded bore (8), wherein the threaded bore (8) is disposed substantially perpendicular to the transverse perforation (9) for receiving a locking screw (26) and is accessible from below in the assembled position, and wherein the mount is fixable in at least one bore (11, 14) provided in a wall of the sanitary installation.

10 Claims, 4 Drawing Sheets

SANITARY INSTALLATION AND MOUNT FOR FIXING A SANITARY INSTALLATION

Figure 1:
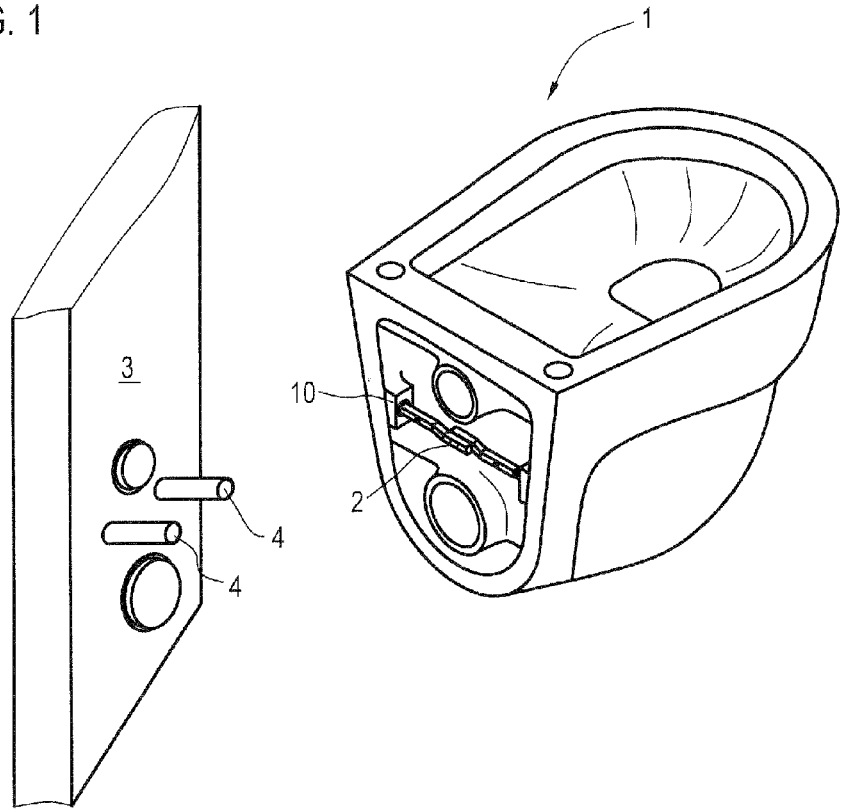

This application claims the priority of DE 10 2009 055 977.9 filed Nov. 27, 2009, which is incorporated by reference herein.

The invention relates to a sanitary installation with a basin body to be fixed in a suspended manner, wherein two bolt-type wall mounts are provided on the wall for fixing.

Sanitary installations may be fixed either in a standing or a suspended manner. In sanitary installations with a basin body to be fixed suspended it is known first to mount two stop screws on the wall on which the sanitary installation is to be fixed for assembly. Then the stop screws are inserted into mounts which have perforations extending correspondingly in the longitudinal direction inside the basin body. To fix the stop screws to the mounts, screws are provided on the mounts which are accessible via hole in the side walls of the basin body. The screws, conventionally grub screws, are screwed against the respective stop screw held [by] the mount.

Thus although the sanitary installation is easy to assemble, the holes on the sides of the sanitary installation are visually unpleasing and complex to manufacture. The manufacturing process is further complicated by additional faces provided with a hole having to be formed by hand on the rear of the sanitary installation facing the wall.

The object of the invention is therefore to indicate a sanitary installation which permits simple assembly together with simple manufacture of the basin body of the sanitary installation.

To achieve this in a sanitary installation of the type mentioned in the introduction it is provided according to the invention that at least one mount is provided which in relation to the assembled position has at least one transverse perforation in the longitudinal direction of the wall mounts for receiving a wall mount and a threaded bore, wherein the threaded bore is disposed substantially perpendicular to the transverse perforation and for receiving a locking screw and is accessible from below in the assembled position, and wherein the mount is fixable in at least one bore provided in a wall of the sanitary installation.

According to the invention it is therefore provided that the locking screw, which connects a wall mount to a mount, is accessible from below. Position indicators such as "below", "laterally" etc. refer, unless otherwise indicated, to the assembly position. Thus the holes in the side walls of the basin body can be avoided. The fixing of the mount in at least one bore in a wall of the sanitary installation additionally avoids parts having to be formed by hand in the ceramic of the basin body. Thus the provision of the bores in the ceramic body which are closed on the outside for receiving the mounts is only possible due to the fact that the threaded bore is accessible from below. The provision of a hole on a side wall of the basin body to make the locking screw accessible avoids the simultaneous provision of a bore on the inner face of the side wall for receiving the mount.

Viewed overall the sanitary installation according to the invention, e.g. a lavatory or bidet, is simpler to manufacture, holes additionally being avoided in the side walls of the basin body.

Preferably the mount can be formed as a transverse strut, the ends of the transverse strut projecting into bores formed substantially horizontally and opposing one another in the side walls of the basin body. The transverse strut thus has a length which is of the order of the distance between the side walls of the basin body, but in order to be able to project into bores in the side walls it is slightly longer. Spaced apart from the ends of the transverse strut are provided the transverse perforations for receiving the wall mounts and, perpendicular to the transverse perforations respectively, threaded bores with which the wall mounts can be fixed to the transverse strut.

The bores, into which the ends of the transverse strut project, may be formed as a perforation and/all as a blind bore. This depends respectively on the configuration of the side wall. If this is in one piece, the bore is formed as a blind bore. If on the inner face of the basin body however an inner face wall substantially parallel to the side wall is provided, this can be perforated to receive an end of the transverse strut. In principle it is then possible to provide on one side of the basin body a single wall with a blind bore and on the other side an additional side wall disposed on the inner face with a perforation, i.e. to combine the configuration options in a single basin body, provided that this should be necessary in the individual case. Obviously it is preferable to form the side walls identically.

Particularly advantageously the transverse strut can have spring elements at the ends for centering or aligning. As the basin body, which usually consists of ceramic or porcelain, is inflexible after manufacture, the mount itself must have devices to enable fixing of the mount to the basin body. In the case of a transverse strut it is in this case ideal to provide spring elements at the ends in order to produce a flexible and yet firm connection between the mount and the basin body. Preferably, as spring elements, helical springs are use. The spring elements also permit compensation for tolerances in the ceramic and any differences in structural widths.

Preferably, the transverse strut can be formed in at least two parts, the individual parts being connectable together. This is advantageous for reasons encountered during assembly. Also by the construction in at least two parts, installation of the mount is considerably simplified, as in this case the ends of the mount can be simply inserted into the bores. Stability is then achieved after connecting the individual parts of the transverse strut together, e.g. by connecting screws.

It is essential for the connection of the wall mounts to the basin body to provide mounts on the basin, in which case a wall mount is fixed to a mount after insertion into a transverse perforation of the mount. The configuration of the mount is in this case not limited to a transverse strut. Alternatively, it can be provided that the sanitary installation has an intermediate wall extending substantially perpendicular to the side walls and having at least two vertical perforations, and in each vertical perforation a bolt-shaped mount is disposed, the mounts each having a holding portion for engaging in the vertical perforation and a fixing portion which is wider in diameter than the holding portion, as well as a transverse perforation and a threaded portion. The transverse perforation can in this case be disposed in the holding portion or in the fixing portion. If the transverse perforation of the mount is provided in the holding portion, then in the intermediate wall additionally to the vertical perforations also a respective transverse perforation is needed. In this case, the wall mount extends both through the intermediate wall and through the mount along the respective transverse perforations.

The holding portion can be inserted into the vertical perforation from above or below, and accordingly the fixing portion is then located above or below the intermediate wall. According to the arrangement, the threaded portion is then either provided in the holding portion or in the fixing portion. If the fixing portion is located above the intermediate wall, the threaded bore is disposed in the holding portion. If in the assembled position the fixing portion is on the other hand below the intermediate wall, then the threaded bore is to be provided in the fixing portion. These embodiments result in the threaded bore having to be accessible from below.

To fix to the intermediate wall, the mount may have a thread and a nut or a circumferential groove and a spring clamping plate. These types of fixing involve the simplest-to-mount and most widespread options. In addition, any further arrangements for fixing can be used, e.g. a transverse perforation in the holding portion for receiving a holding pin if required.

Instead of providing a thread or an circumferential groove, alternatively at least two mounts can be provided which are connected by a transverse strut and for fixing are supported by second intermediate walls which are aligned substantially parallel to the intermediate wall extending substantially horizontally in the assembled position. In this case, the mounts are clamped as it were between the intermediate wall and the second intermediate walls. Thus the mounts can also be securely connected to the basin body so that it cannot be removed from the screw-fixed mounts.

Preferably, the intermediate wall can be provided with a recess. The recess can in this case extend the full length, so that effectively two adjacent intermediate walls are present. The recess is not limited in it width, in particular the recess may even be wider than the respectively remaining widths of the intermediate wall. In this application therefore there is still only one intermediate wall mentioned even if the intermediate wall can also be viewed as consisting of two intermediate walls due to the recess.

Particularly advantageously, the mount for receiving the wall mount may have a preferably detachable insertion sleeve. The insertion sleeve has a funnel-shaped cross-section and is used to guide the wall mount into the transverse perforation of the mount. Thus the insertion of the wall mounts into the transverse perforations is considerably simplified as on the one hand the aperture into which the wall mount is to be inserted is closer to the rear of the basin body and on the other hand the aperture to be met is enlarged. Insertion sleeves consist usually of plastics or metal. In addition to the funnel-shaped portion the insertion sleeve also has a cylindrical portion for insertion into the transverse perforation of the mount. In this cylindrical portion, a perforation is to be provided in order that the locking screw can further fix the wall mount.

The basin body may be formed as a lavatory or bidet.

In addition the invention relates to a mount for fixing a sanitary installation with a basin body to be fixed to a wall in a suspended manner. The mount is characterised in that in relation to the assembled position it has at least one transverse perforation of bolt-like wall mounts to be provided on the wall in the longitudinal direction for receiving a wall mount and a threaded bore, the threaded bore being disposed substantially perpendicular to the transverse peroration in order to receive a locking screw, and the mount has at least one holding portion which may be inserted into a bore to be provided in a wall of the sanitary installation. Corresponding embodiments and further developments of the mount appear from the subclaims.

Figure 2:
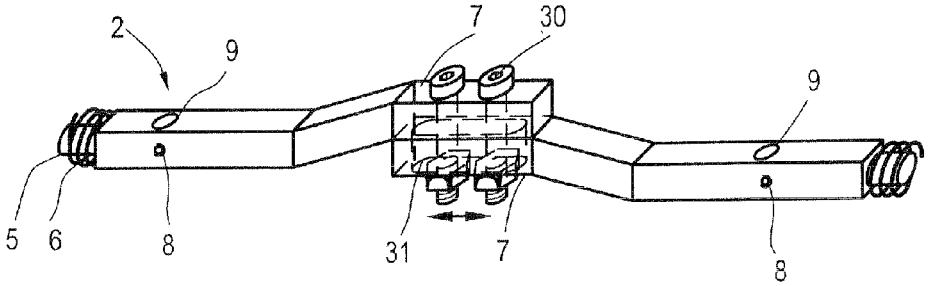

Further advantages, features and details of the invention will appear from the embodiments described below and from the drawings, which show:

FIG. 1 a lavatory,

FIG. 2 a transverse strut in a first view

Figure 3:
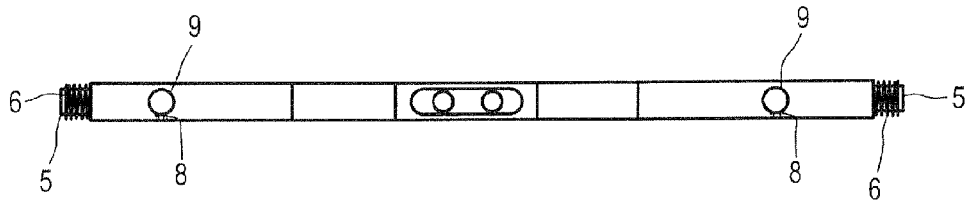

FIG. 3 a transverse strut in a second view

Figure 4:
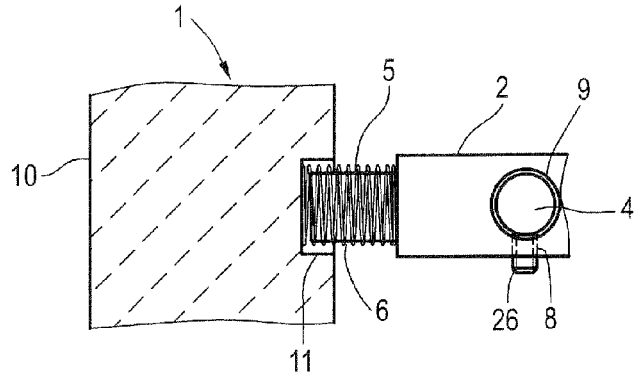

FIG. 4 a partial view of a basin body and a transverse strut

Figure 5:
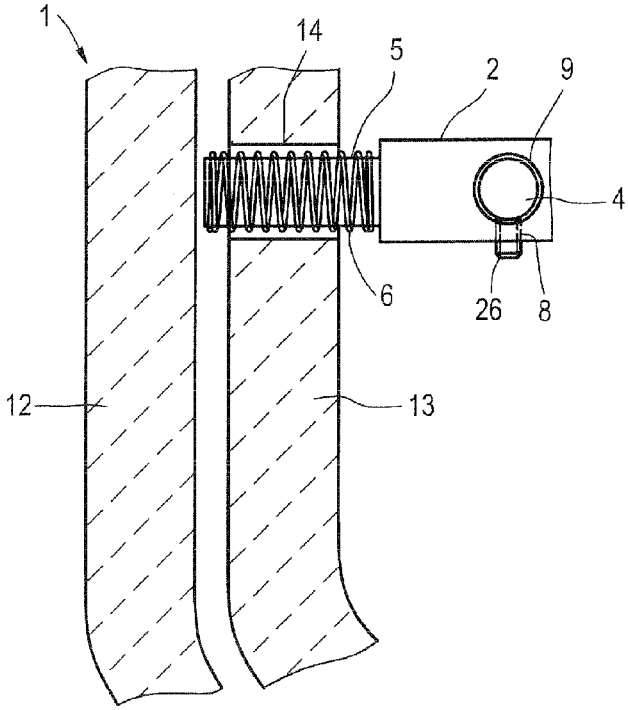

FIG. 5 a partial view of a basin body and a transverse strut

Figure 6:
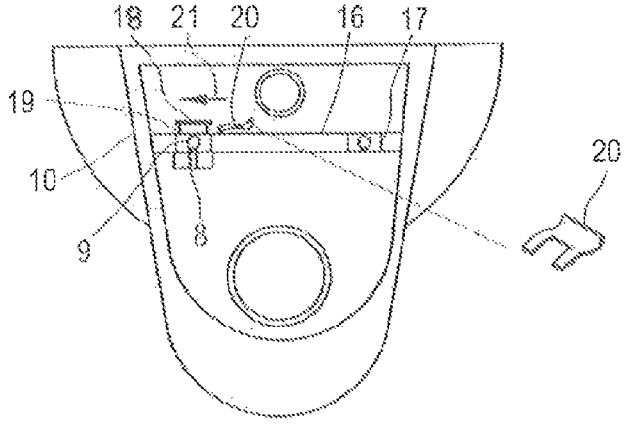

FIG. 6 a cross-section through a basin body in a first embodiment

Figure 7:
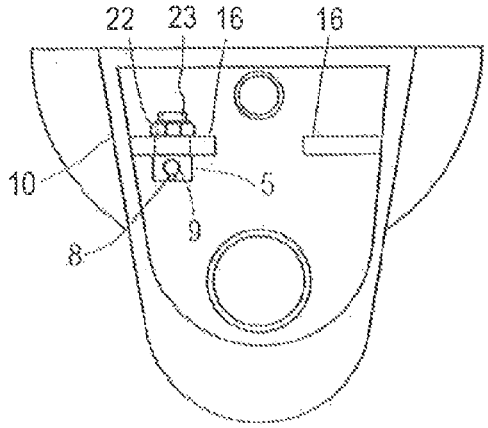

FIG. 7 a cross-section through a basin body in a second embodiment

Figure 8:
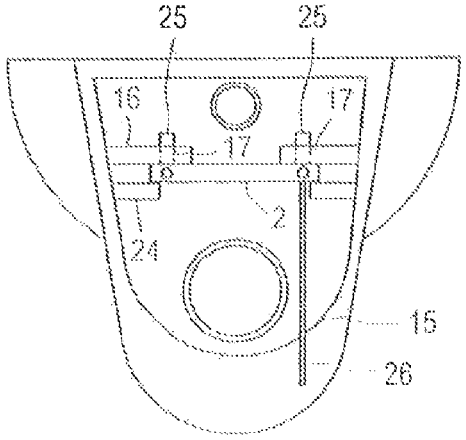

FIG. 8 a cross-section through a basin body in a third embodiment, and

Figure 9:
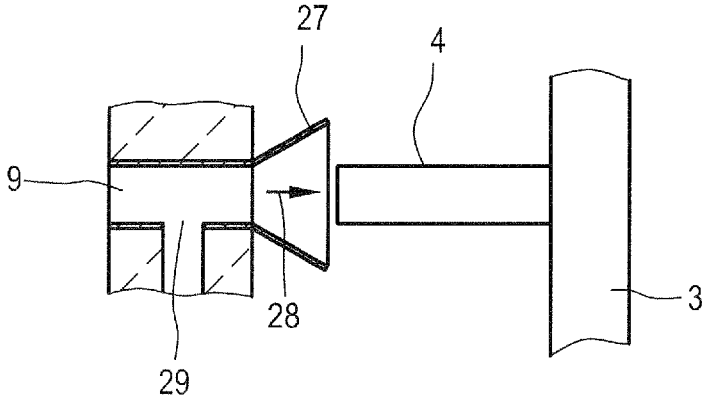

FIG. 9 a principle diagram of a mount with insertion sleeve.

FIG. 1 shows a lavatory 1 having a transverse strut 2 in front of a wall 3, from which two stop screws 4 are projecting. For assembly, at least two stop screws are provided which are fixed to the wall 3.

FIG. 2 shows a more precise representation of the transverse strut 2 in a view from below. The transverse strut 2 cranked at both ends has holding portions 5, which are insertable in opposing bores in the side walls of the lavatory. For centering the transverse strut 2 spring elements in the form of helical springs 6 are disposed on the holding portions 5. The transverse strut 2 consists of two individual parts 7, which are connectable together in the overlapping region via connecting screws 30. Because the transverse strut 2 is formed in two parts, the respective holding portions 5 can be easily inserted into the bores in the side walls 10 of the lavatory 1. As the diagram shows the transverse strut from below, the threaded bores 8 for receiving the locking screws are visible. In this case the threaded bore 8 is so formed in each case that it opens into a transverse perforation 9, which is only hinted at in this diagram.

FIG. 3 shows the transverse strut 2 in a front view. In this view, which represents the view in the assembled position, the transverse perforations 9 are clearly visible. The threaded bores 8 lead from below to the respective transverse perforations.

In order to enable fixing of the lavatory 1 to the wall 3, it is necessary for reasons of statics that the transverse strut 2 can be fixed in the upper region of the side walls of the lavatory 1. In order that the lavatory 1 remains fixed in place when subjected to a load, corresponding counter-forces must be present. These counter-forces are transmitted via the transverse strut 2 and the stop screw 4 to the lavatory 1. If the transverse strut 2 is disposed too low, the lavatory 1 may easily tilt downwards due to leverage. Tilting is prevented if the transverse strut 2 is mounted in the upper half of the basin body.

In installing the transverse strut 2, there are two different embodiments. FIG. 4 shows a side wall 10 with a blind bore 11 into which the holding portion 5 of the transverse strut 2 is inserted. As the bore is formed as a blind bore 11, no visible hole appears on the exterior of the side wall 10.

Alternatively, if there are two side walls, i.e. an outer side wall 12 and an inner side wall 13, the bore may also be formed as a perforation 14, as is shown in FIG. 5. In this case also, no hole appears on the exterior of the side wall 12, whilst the holding portion 5 can be inserted fully into the perforation 14. In this embodiment, the wall thickness of the outer side wall 12 can also be kept smaller than if a blind bore 11 is provided in the side wall 10.

In FIGS. 4 and 5, respectively a stop screw 4 can be seen which is inserted into a transverse perforation 9. The stop screw 4 is fixed by means of the locking screw 26 in the threaded bore 8. Also shown is that a spring element 6 respectively bears on the inner wall adjacent to the blind bore 11 or to the perforation 14.

Alternatively to a transverse strut 2, also an intermediate wall 16 with vertical perforations 17 can be provided into which the bolt-shaped mounts 18 are inserted. In this case there are plural configurations which may be combined.

The first embodiment relates to the intermediate wall 16. This may be formed in one piece, as is shown in FIG. 6, but may also be provided with a relatively wide recess and thus formed in two parts, cf. FIG. 7. In both cases, an intermediate wall 16 is mentioned. The embodiment of the intermediate wall 16 is independent of the embodiments of the bolt-shaped mount 18.

The bolt-shaped mount 18 is divided into a holding portion, which engages in the vertical perforation or penetrates the same, and a fixing portion. In FIG. 6, the fixing portion lies below the intermediate wall 16 and is provided with the threaded bore 8. The transverse perforation 9 can be disposed in the holding portion as in FIG. 6 or in the fixing portion as in FIG. 7. If the transverse perforation 9 is disposed in the holding portion, the intermediate wall 16 must have in addition to the vertical perforation 17 a transverse perforation in order that the stop screw 4 can be inserted into the transverse perforation 9 of the bolt-shaped mount 18. To fix the bolt-shaped mount 18, two options are described which are independent of the arrangement of the transverse perforation 9 in the holding portion or fixing portion. On the one hand, as is shown in FIG. 6, a circumferential groove 19 can be provided, wherein the bolt-shaped mount 18 is fixed by means of a spring clamping plate 20 to the intermediate wall 16. For this, the spring clamping plate 20 is simply wedged in the direction of the arrow 21 against the groove 19 of the bolt-shaped mount 18. Instead, the holding portion may also, as is visible in FIG. 7, have a thread 22 on to which a nut 23 may be screwed.

Obviously, in this case, washers or similar devices may be placed between the nut 23 and the intermediate wall 16.

FIG. 8 shows a further embodiment in which further intermediate walls 24 are provided which are disposed parallel to the intermediate wall 16 and perpendicular to the side wall 10. Via these further intermediate walls 24 a transverse strut 2 with bolt-shaped mounts 25 can be fixed, the mounts 25 being fixed simultaneously to one another and to the basin body.

For simple assembly of the lavatory 1, the locking screw 26 is formed as a long screw. Thus the locking screw 26 can be simply reached from below with a wrench, and in particular driving of the locking screw 26 can also be easily achieved. The embodiment of the locking screw 26 as a long screw is obviously possible for all embodiments.

FIG. 9 shows the possible arrangement of an insertion sleeve 27 which has a funnel-shaped portion and a cylindrical portion, the cylindrical portion being inserted into a transverse perforation 9. To insert the stop screw 4 into the transverse perforation 9, the basin body of the lavatory is moved in the direction of the arrow 28, whereby also the insertion sleeve 27 and the transverse perforation 9 are moved in this direction. By means of the insertion sleeve 27, the insertion of the stop screw 4 into the transverse perforation 9 is substantially simplified. In order that the locking screw 26 can fix the stop screw 4, the insertion sleeve 27 has a perforation 29. This is ultimately a circular hole in the cylindrical portion.

The insertion sleeve 27 can also obviously be used in all the embodiments described as in any case it only requires that a perforation 9 is provided.

The invention claimed is:

1. A sanitary installation comprising:

a basin body adapted to be fixed on two stop screws provided on a wall in a suspended manner, the basin body comprising:

first and second side walls having first and second bores formed substantially horizontally and opposing one another in the first and second side walls; and at least one mount comprising at least one transverse perforation in the longitudinal direction of the stop screws for receiving one of the stop screws and a threaded bore;

wherein the threaded bore is disposed substantially perpendicular to the transverse perforation for receiving a locking screw, and in an assembled position, the locking screw is accessible from below wherein the at least one mount is fixable in the first and second bores;

wherein the at least one mount further comprises transverse strut having first and second ends that project into the first and second bores in the first and second side walls.

2. The sanitary installation according to claim 1, wherein each of the first and second bores is formed as one of a perforation and a blind bore.

3. The sanitary installation according to claim 1, wherein the transverse strut comprises one or more spring elements at the first and second ends for centering.

4. The sanitary installation according to claim 1, wherein the transverse strut comprises first and second parts, the first and second parts being connectable together.

5. The sanitary installation according to claim 1, wherein the at least one bolt shaped mount comprises a detachable insertion sleeve adapted to receive a stop screw.

6. The sanitary installation according to claim 1, wherein the basin body comprises one of a lavatory and a bidet.

7. A sanitary installation comprising:

a basin body adapted to be fixed on two stop screws provided on a wall, in a suspended manner, the basin body comprising a first and second side walls; and an intermediate wall substantially perpendicular to the first and second side walls, at least two vertical perforations in the intermediate wall, a bolt-shaped mount is disposed in each vertical perforation, each bolt shape mount comprising a transverse perforation in the longitudinal direction of the stop screws for receiving one of the stop screws and a threaded bore, wherein the threaded bore is disposed substantially perpendicular to the transverse perforation for receiving a locking screw and in an assembled position the locking screw is accessible from below, and each bolt shaped mount has a holding portion for engaging in the vertical perforation; and a fixing portion which is wider in diameter than the holding portion.

8. The sanitary installation according to claim 7, wherein, for fixing to the intermediate wall, each bolt shaped mount comprises one of:

a thread and a nut; and a circumferential groove and a spring clamping plate.

9. The sanitary installation according to claim 7, wherein the bolt shaped mounts are connected by a transverse strut and are supported from below by second intermediate walls aligned substantially parallel to the intermediate wall extending substantially horizontally in the assembled position.

10. The sanitary installation according to claim 7, wherein the intermediate wall comprises a recess.

* * * * *